United States Patent [19]

Cloup

[11] 4,021,153

[45] May 3, 1977

[54] LIQUID METERING PUMPS

[76] Inventor: Jean Cloup, 33360 Latresne, France

[22] Filed: Mar. 1, 1976

[21] Appl. No.: 662,326

[30] Foreign Application Priority Data

Mar. 5, 1976 France ..... 76.06916

[52] U.S. Cl. ..... 417/443; 417/566; 417/489

[51] Int. Cl.[2] ..... F04B 7/00

[58] Field of Search ..... 92/127; 222/380, 409; 417/437, 443, 566, 489

[56] References Cited

UNITED STATES PATENTS

| | | | |
|---|---|---|---|
| 835,162 | 11/1908 | Morrill | 417/489 |
| 1,513,870 | 11/1924 | Sparrow | 417/443 |
| 1,587,830 | 6/1926 | Heine | 417/555 |
| 2,064,750 | 12/1936 | Hurst | 92/129 |
| 2,569,903 | 10/1951 | Santarelli | 417/489 |
| 2,574,779 | 11/1951 | Fels | 92/129 |
| 2,591,969 | 4/1952 | Sawchuk | 417/489 |
| 2,795,195 | 6/1957 | Amblard et al. | 417/437 |
| 3,719,437 | 3/1973 | Schuhmann | 417/489 |

*Primary Examiner*—William L. Freeh
*Attorney, Agent, or Firm*—Bucknam and Archer

[57] ABSTRACT

This invention relates to liquid metering pumps and according to the invention such a pump comprises a cylinder permanently connected to an inlet passage for the liquid and in which said cylinder a plunger piston is arranged to slide said piston co-operating with a sealing gland on the inlet side. The piston is urged by an elastic member into contact with a reciprocable actuating rod which co-operates with a sealing gland on the outlet side. The two sealing glands are separated by a spacer to form an annular chamber around the plunger piston and the actuating rod.

4 Claims, 3 Drawing Figures

LIQUID METERING PUMPS

BACKGROUND OF THE INVENTION

The present invention relates to liquid metering pumps, and has for an object, improvements therein.

To inject metered amounts of liquid into another liquid it is known to use metering pumps which consist of a cylinder in which a piston moves. The piston draws in the liquid to be metered and delivers it to another container. This container may in particular be an injection device as described in French patent No. 2,205,361.

However, such a metering pump is chiefly useful for obtaining relatively large volumes of liquid and is not suited to small amounts which have to be very accurately metered.

It is an object of this invention to minimize or overcome this disadvantage and to allow very small throughputs to be obtained.

SUMMARY OF THE INVENTION

The invention consists in a liquid metering pump comprising a cylinder which is permanently connected to an inlet passage for the liquid to be metered and in which a plunger piston, which co-operate with a sealing gland on the inlet side, is mounted to slide, the said plunger piston being urged by an elastic member into contact with a reciprocable actuating rod which co-operates with a sealing gland on the outlet side, the said sealing glands at the inlet and outlet being separated by a spacer so as to form an annular chamber around the plunger piston and the actuating rod.

Accuracy results mainly from the fact that the operating travel is precisely defined by the active length of the plunger piston and by the cross-sectional areas of the piston and the actuating rod.

In addition, the dead space in this device is relatively small and allows easy auto-priming.

BRIEF DESCRIPTION OF THE DRAWINGS

In order that the invention may be more clearly understood, one specific embodiment thereof will now be described with reference to the accompanying drawings by way of example and in which.

DETAILED DESCRIPTION OF THE PREFERRED EMBODIMENT

Figure 1:
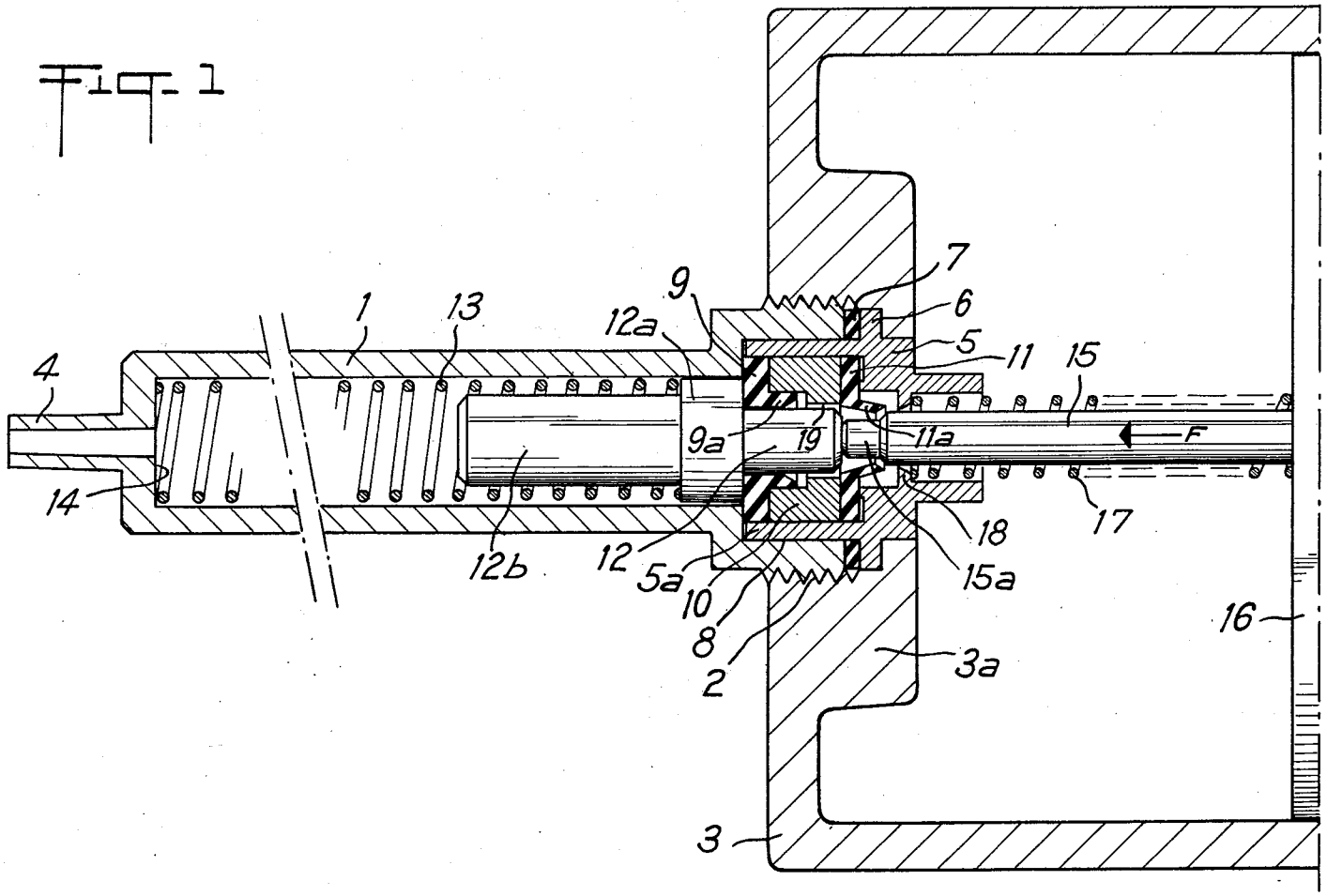
FIG. 1 is a longitudinal section through an improved metering pump according to the invention in the position assumed at the end of the outlet stroke.
Figure 2:
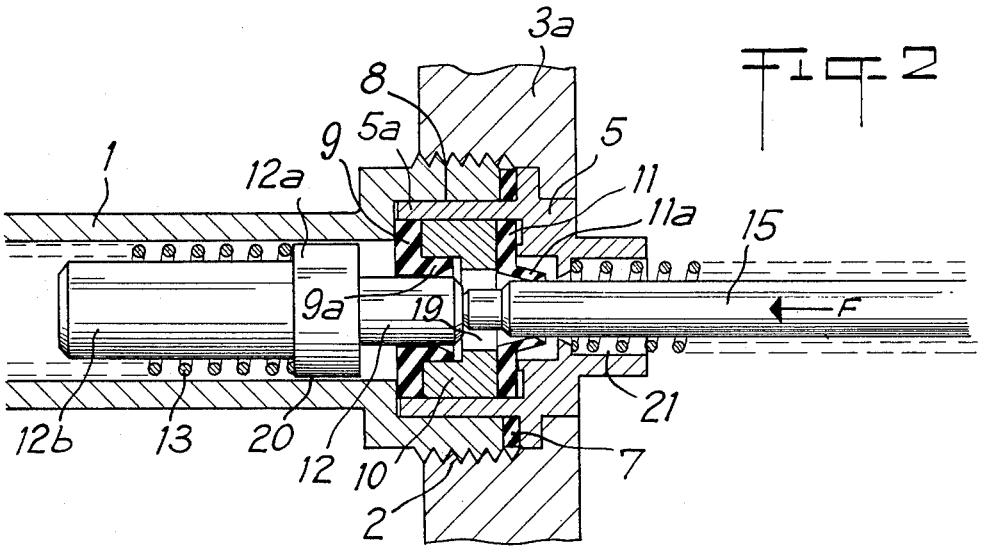
FIG. 2 is a similar view of the pump with the plunger piston in an intermediate position.
Figure 3:
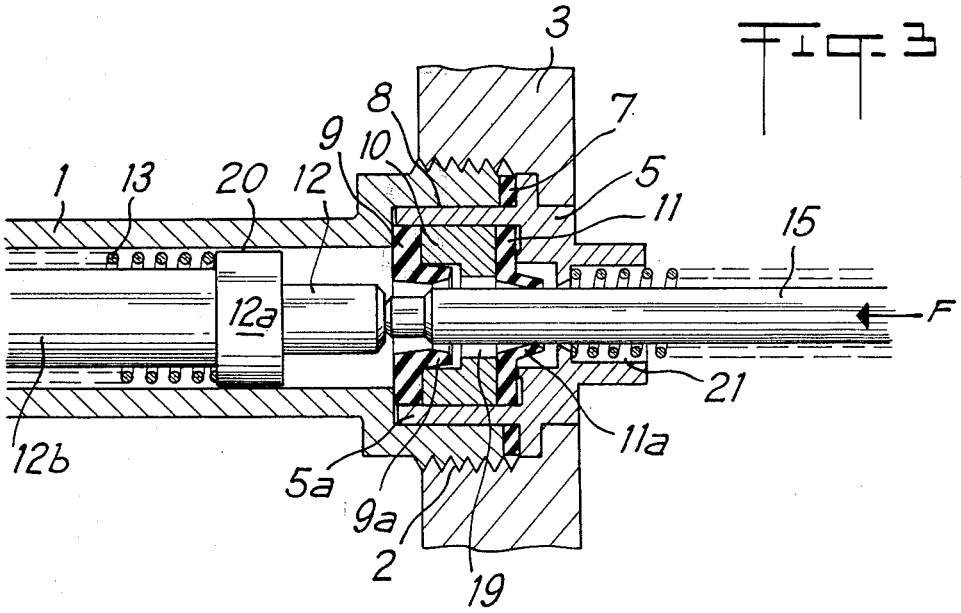
FIG. 3 is a similar view of the pump in the position assumed at the end of the inlet stroke.

Referring now to the drawings, FIGS. 1, 2 and 3 show an embodiment of metering pump according to the invention, which is formed by a cylinder 1 which has at one of its ends a threaded portion 2 by which it is attached to a container 3, which may in particular be an injection device as described in French patent No. 2,205,361.

At the opposite end the cylinder 1 has an inlet tube 4 for the liquid to be metered.

In the wall 3*a* of the container 3 is provided a seating intended to receive a body 5. The body 5 is held pressed against a shoulder 6, with a sealing gland 7 interposed, by the threaded part 2 of cylinder 1. Cylinder 1 contains a chamber 8 into which fits an annular part 5*a* of body 5.

In this annular part 5*a*, a sealing gland 9 situated on the inlet side, a spacer 10, and a sealing gland 11 situated on the outlet side are held clamped between cylinder 2 and body 5.

The sealing glands 9 and 11 are made of an elastic material and have circular lips 9*a* and 11*a* which define an inlet orifice and an outlet orifice respectively.

A plunger piston 12, which has a widened portion 12*a* to guide it in the cylinder and a stem 12*b* is mounted to slide in cylinder 2. The said plunger piston 12, which co-operates with the circular lip 9*a* on the inlet gland 9, is subject to the urging of a coil spring 13 which bears at one end against one of the faces of widened portion 12*a* and at the other end against the end wall 14 of cylinder 1. The other face of the said widened portion 12*a* in turn abuts against gland 9 under the urging of spring 13, as shown in FIG. 1.

At the opposite end from the widened portion, plunger piston 12 is in contact with the end of an actuating rod 15 which executes a reciprocating movement which is imparted to it by a piston 16 to which it is attached and which is described in greater detail in French patent No. 2,205,361.

This actuating rod 15, whose cross-section is smaller than that of plunger piston 12, co-operates with the circular lip 11*a* on outlet gland 11 and when it executes its stroke in the direction of arrow F it thrusts plunger piston 12 back in opposition to spring 13.

The end of rod 15 has a reduced portion 15*a* of smaller diameter so that a space is left between the reduced portion and lip 11*a*.

A spring 17 is arranged around rod 15 and it bears at one end against a shoulder 18 in body 5 and at the other end against piston 16.

The inlet and outlet sealing glands 9 and 11 and the spacer 10 define an annular chamber 19 around plunger piston 12 and rod 15.

The metering pump operates in the following way:

In FIG. 1 the plunger piston 12 is shown at the end of its delivery travel when the outlet valve formed by lip 11*a* and the end 15*a* of rod 15 is in the open position.

When rod 15 is moved in the direction of arrow F, plunger piston 12 is thrust back in the same direction and compresses spring 13 (FIG. 2).

Rod 15 is in contact with circular lip 11*a* while plunger piston 12 is in contact with circular lip 9*a* and the result is that pressure is reduced in the annular chamber 19, which is cut off on both the inlet and the outlet sides, with a view to assisting the intake of liquid in the following phase.

As the movement of rod 15 continues in the direction of arrow F, plunger piston 12 is thrust back to the end of travel position shown in FIG. 3 in which it is no longer in contact with lip 9*a*. In this position, since rod 15 is of smaller diameter than the plunger piston, the liquid is able to enter chamber 19 through the passage which exists between lip 9*a* and rod 15.

Rod 15 on the other hand is still in contact with lip 11*a* thus preventing any leakage to the outlet. When the plunger piston 12 is no longer in contact with the lip 9*a* on gland 9, the liquid to be metered, coming from tube 4, enters cylinder 1 and entirely fills both it and chamber 19, due to the clearance 20 provided between cylinder 1 and widened portion 12*a*.

When the actuating rod 15 is moved in the opposite direction from arrow F, piston 12 re-enters the opening defined by the lip 9*a* under the prompting of spring 13 and a predetermined quantity of liquid is trapped in chamber 19 between lips 9*a* and 11*a* on glands 9 and 11 (FIG. 2).

As it continues its travel in the opposite direction from arrow F, piston 12 compresses the liquid trapped in chamber 19 and, as a result of the pressure from the liquid, lip 11*a* is raised and allows the said liquid to escape into container 3 through the passage 21 in body 5. At the end of their travel piston 12 and rod 15 assume the positions shown in FIG. 1, in which lip 11*a* is completely clear of rod 15, thus allowing free passage between chamber 19 and the passage 21 connected to container 3.

The cycle as described above then begins again.

I claim:

1. A liquid metering pump, comprising a cylinder which is permanently connected to an inlet passage for the liquid to be metered, a plunger piston, which co-operates with a sealing gland on the inlet side, mounted to slide in said cylinder, said plunger piston being urged by an elastic member into contact with a reciprocable actuating rod which co-operates with a sealing gland on the outlet side, the said sealing glands at the inlet and outlet sides being separated by a spacer so as to form an annular chamber around said plunger piston and said actuating rod.

2. A metering pump according to claim 1, wherein said plunger piston is of larger cross-sectional area than said actuating rod.

3. A metering pump according to claim 1, wherein said sealing glands are made of an elastic material and have circular lips which define openings in which said plunger piston or said actuating rod are engageable.

4. A metering pump according to claim 1, wherein said plunger has at the opposite end from said actuating rod a widened portion, one of whose faces is able to come to bear against said inlet gland and whose other face forms a shoulder against which one of the ends of a coil spring abuts, said coil spring bearing at the other end against the end wall of said cylinder and said widened portion extending on the opposite side from said plunger piston into a stem of smaller cross-sectional area which fits into said spring.

* * * * *